US009237835B2

(12) United States Patent
Amoretti

(10) Patent No.: US 9,237,835 B2
(45) Date of Patent: Jan. 19, 2016

(54) COLLECTING APPARATUS OF SUCKED MATERIALS FOR VACUUM CLEANER APPLIANCES

(75) Inventor: Luigi Amoretti, Mussolente (IT)

(73) Assignee: T.P.A IMPEX S.P.A., Romano d'Ezzelino (Vicenza) (IT)

( * ) Notice: Subject to any disclaimer, the term of this patent is extended or adjusted under 35 U.S.C. 154(b) by 919 days.

(21) Appl. No.: 13/472,355

(22) Filed: May 15, 2012

(65) Prior Publication Data

US 2012/0291219 A1 Nov. 22, 2012

(30) Foreign Application Priority Data

May 17, 2011 (IT) ..... MO2011A0116

(51) Int. Cl.

| | |
|---|---|
| ***A47L 9/18*** | (2006.01) |
| ***A47L 5/22*** | (2006.01) |
| ***A47L 9/10*** | (2006.01) |
| ***A47L 9/12*** | (2006.01) |

(52) U.S. Cl.

CPC ..... *A47L 9/181* (2013.01); *A47L 5/225* (2013.01); *A47L 9/10* (2013.01); *A47L 9/106* (2013.01); *A47L 9/108* (2013.01); *A47L 9/127* (2013.01)

(58) Field of Classification Search

CPC ..... A47L 9/18; A47L 9/181; A47L 9/182; A47L 9/183; A47L 9/127; A47L 9/106; A47L 9/10; A47L 9/108; A47L 5/225

USPC ..... 15/353

IPC ..... A47L 9/18

See application file for complete search history.

(56) References Cited

U.S. PATENT DOCUMENTS

| | | | | |
|---|---|---|---|---|
| 4,251,241 | A | 2/1981 | Bothun | |
| 4,287,635 | A | 9/1981 | Jacobs | |
| 5,192,344 | A | 3/1993 | House | |
| 6,440,191 | B1 | 8/2002 | Berfield et al. | |
| 2006/0010639 | A1 * | 1/2006 | Yuen | 15/347 |
| 2012/0311811 | A1 * | 12/2012 | Hollis et al. | 15/327.1 |

FOREIGN PATENT DOCUMENTS

| | | |
|---|---|---|
| GB | 1542994 | 3/1979 |

* cited by examiner

*Primary Examiner* — David Redding

(74) *Attorney, Agent, or Firm* — Themis Law

(57) ABSTRACT

A collection apparatus for use in vacuum cleaners appliance to collect sucked up materials includes a tank that has a bottom, peripheral walls and an upper opening opposite to the bottom, and that is adapted to be closed by a removable lid; suction means that are coupled to the tank to create a negative pressure therein; and separation means that separate the sucked up materials from the air flows moving in a suction direction defined from an inlet into the tank and an outlet from the tank, which are either wet separation means or dry separation means that can be alternately and interchangeably mounted within the tank using removable mounting means.

11 Claims, 5 Drawing Sheets

COLLECTING APPARATUS OF SUCKED MATERIALS FOR VACUUM CLEANER APPLIANCES

FIELD OF THE INVENTION

The invention relates an apparatus for collecting sucked materials for vacuum cleaner appliances.

BACKGROUND ART

Vacuum cleaners are known, both for domestic and industrial use, in which an internal tank is provided, typically removable from the body of the appliance and having a substantially horizontal flat bottom, for receiving the flow of air sucked up from the outside, with collected dirt and debris mixed therewith.

According to a first technique, known as wet filtration, the tank is loaded with a water volume that fills a portion of limited height and the flow of sucked up air is bubbled through this water volume to cause the release of collected debris and remove fine particulate matter.

The air emerging from the water volume flows back to the outside environment through a special path, and possibly flows therein over the motor of the appliance for cooling it and through a fine-mesh filter for removing any fine particulate residues.

A vacuum cleaner appliance is also known which comprises a dynamic dust removal unit, which is mounted in the tank containing the water volume.

This dynamic dust removal unit comprises a rotatably motor-driven fan which is mounted to the tank ceiling.

The fan has a large number of blades, with passages for the sucked up air therebetween, communicating with a pipe for collecting air and conveying it to the outside.

The fan is driven by a motor whereby it provides the sucking action, by creating a negative pressure in the tank.

The air emerging from the water volume after bubbling and release of debris and fine particulate matter is sucked up through the passages defined between the blades and any residual suspended dirt particles or debris are separated from the air flow by direct impact against the blades of the rotating fan.

The particles rejected by the blades fall back into the water volume with those collected during bubbling, for disposal when the water volume is heavily loaded with dirt and is emptied from the tank and replaced with a new clean water volume.

According to another technique, known as dry filtration, vacuum cleaners are known in which the debris and dirt collection tank uses no water but only one or more filters mounted in the tank or directly to the motor that generates the suction force, which filters separate the debris and the particulate matter from the flow of sucked up air prior to reintroduction thereof into the environment after purification.

While these known appliances have an adequate operation, they still suffer from certain drawbacks.

A first drawback is that each vacuum cleaner appliance is manufactured and commercially available in one of the above described versions only.

Therefore, in order that a user can purify the sucked up air prior to reintroduction thereof into the environment using wet filtration, by simple bubbling in water or by dynamic dust removal, or using dry filtration, he/she should buy three distinct appliances, or select one of them and give up the others.

A further drawback of prior art appliances is that the bottom of the compartment in which the sucked up dirt is collected is substantially flat and parallel to the ground, whereby the solid debris sucked up and separated from the air flow are collected on the bottom in random fashion, and no spontaneous accumulation area is provided, for such debris to be quickly picked up and discharged without repeatedly removing the tank from the suction cleaner when small amounts of collected debris and particulate matter are present.

SUMMARY OF THE INVENTION

One object of the invention is to improve the prior art.

Another object of the invention is to provide a collection apparatus for collecting sucked up materials in vacuum cleaner appliances, that allows users to select the method of collected dust removal, without purchasing multiple appliances, and by simply adapting a single appliance to the selected technique.

Yet another object of the invention is to provide a collection apparatus for collecting sucked up materials in vacuum cleaner appliances, that allows dirt debris and particulate matter collected and separated from the sucked up air flow to build up in a predetermined area of the collecting compartment bottom.

The invention relates to collection apparatus for collecting sucked-up materials for use in vacuum cleaner appliances as described hereinafter.

BRIEF DESCRIPTION OF THE DRAWINGS

Further characteristics and advantages of the invention will be more apparent upon a reading of the detailed description of a collection apparatus for collecting sucked up materials for use in vacuum cleaner appliances, which is illustrated by way of example and without limitation in the annexed drawings, in which.

DETAILED DESCRIPTION OF A PREFERRED EMBODIMENT

Particularly referring to the figures, numeral 1 generally designates an industrial vacuum cleaner appliance having a collection apparatus 2 for collecting sucked-up material according to the invention.

Figure 1B:
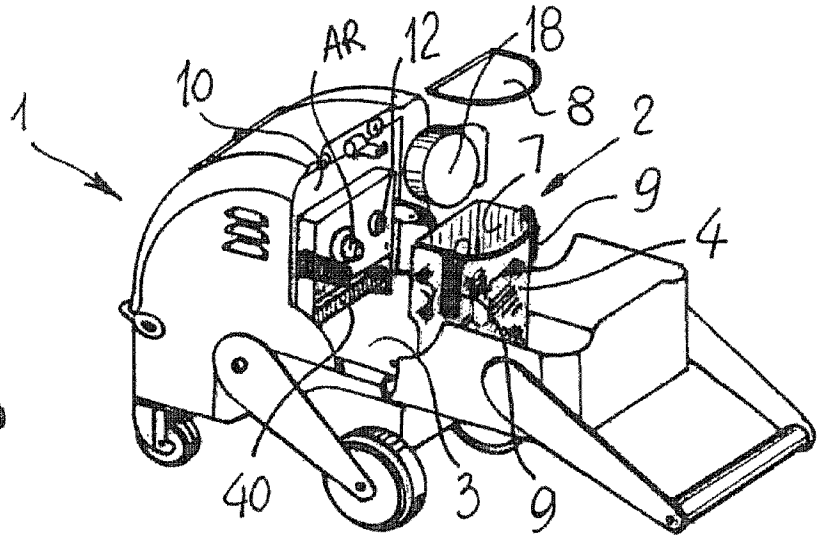
FIGS. 1*a* to 1*c* show an industrial vacuum cleaner appliance through three steps for mounting or removing an inventive collection apparatus for collecting sucked up materials, according to a first embodiment in which the collection apparatus is mounted within the vacuum cleaner appliance.
Figure 1A:
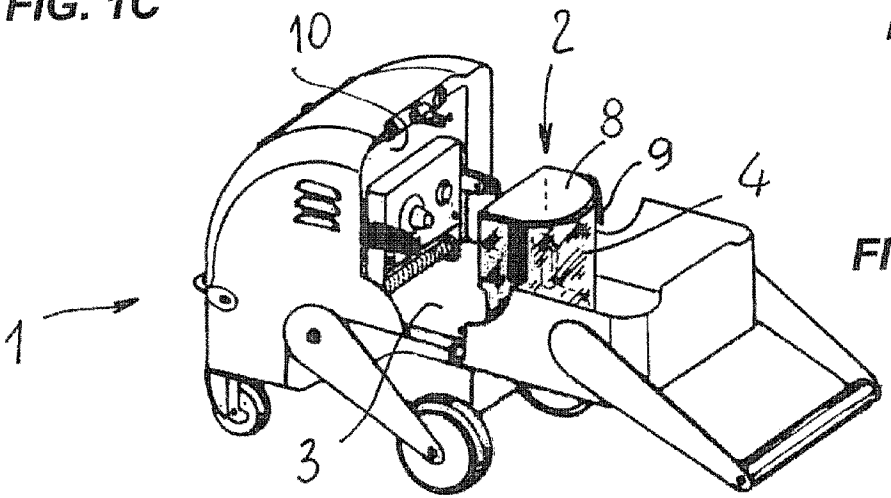
Figure 1C:
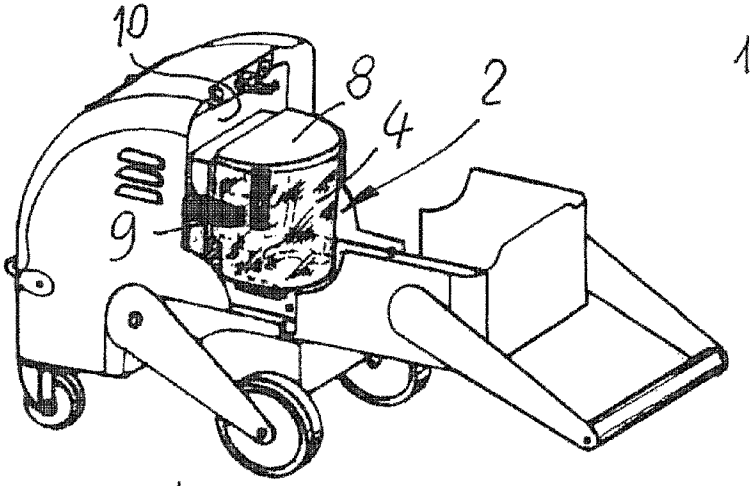
Figure 2:
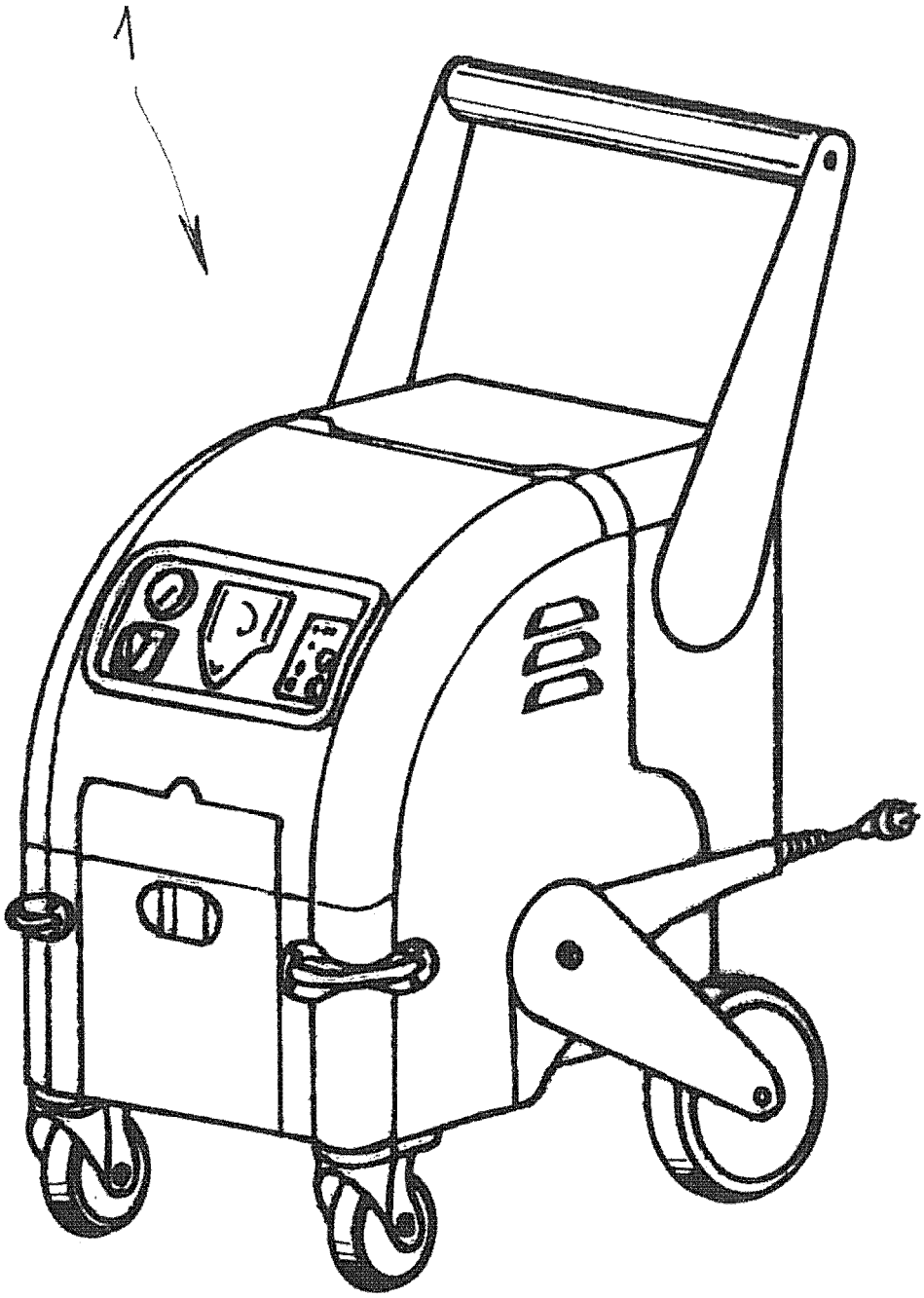
FIG. 2 is a side view of one embodiment of a vacuum cleaner appliance ready for use, with the collection apparatus of the invention external to the body of the apparatus.

The collection apparatus 2 may be disposed either within the vacuum cleaner appliance 1, in a special internal seat 3, as shown in FIGS. 1*a* to 1*c*, or external thereto, as shown in greater detail in FIG. 2.

In both cases, the collection apparatus 2 comprises a tank 4 having peripheral walls 5, a bottom 6 and an upper opening 7, opposite to the bottom 6, which is adapted to be closed by a removable lid 8, providing access to the interior compartment of the tank 4.

The latter has hooks 9 for removable attachment thereof to a wall 10 of the vacuum cleaner appliance 1, which wall has suction means 11 associated therewith for creating a negative pressure in the tank 4 and a suction port 12 designed to be coupled to a corresponding inlet 13 formed in a support wall 4*a* of the tank 4, the latter wall being designed to face towards the wall 10 of the vacuum cleaner apparatus 1 when the tank 4 is in a mounted operating state.

The tank has separation means for separating the sucked up material from sucked air flows in a suction direction "A" defined between the inlet 13 and an outlet 14 from the tank 4.

The separation means include separation means selected from wet separation means, generally referenced 15, and dry separation means, generally referenced 16 which, as described in greater detail below, can alternately and interchangeably mounted in said tank 4 using removable mounting means 17*a* associated with the tank 4 and 17*b* associated with the separation means 15 and 16 and designed to be coupled to the corresponding means 17*a*.

As used herein, the terms "wet separation means" and "dry separation means" indicate that the former operate using a volume of liquid "VA", typically water, loaded in the tank 4, to separate sucked up debris and particulate matter from sucked up air flows, whereas the latter use no liquid volume, and separation occurs either by gravity or using washable or replaceable filter means, namely a cylindrical filter 18.

Figure 13:
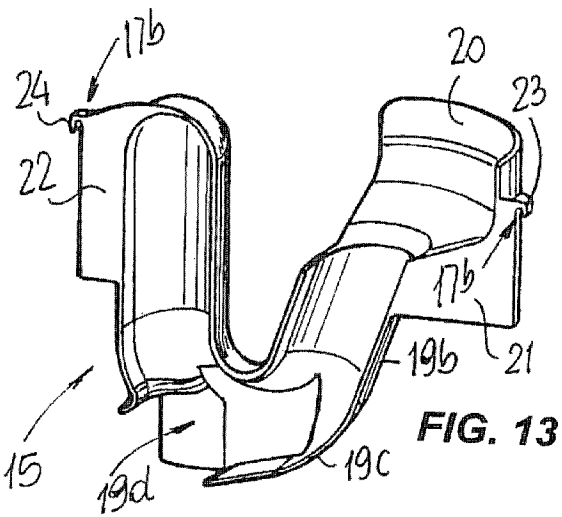
FIG. 13 is a rear perspective view of means for wet separation of the sucked up materials from the sucked up air flows.

Referring to FIGS. 3, 4, 5, 10, 13, 14, it will be appreciated that the wet separation means 15 comprise, in greater detail, a siphon pipe, generally referenced 19, having a closed front portion and, as shown in FIG. 13, an open rear portion, which is designed to be sealed by the support wall 4*a* of the tank 4 when the separation means 15 are mounted therein.

Therefore, the pipe 19 comprises a first straight section 19*a* for conveying flows of air and debris and particulate matter suspended therein towards the bottom 6 of the tank 4, which section originates at the inlet 14 and dips into the water volume "VA", a second straight section 19*b* emerging from the water volume "VA" and oriented towards the suction means 11 and a central siphoning elbow section 19*c*.

Figures 3, 4, 5, 10:
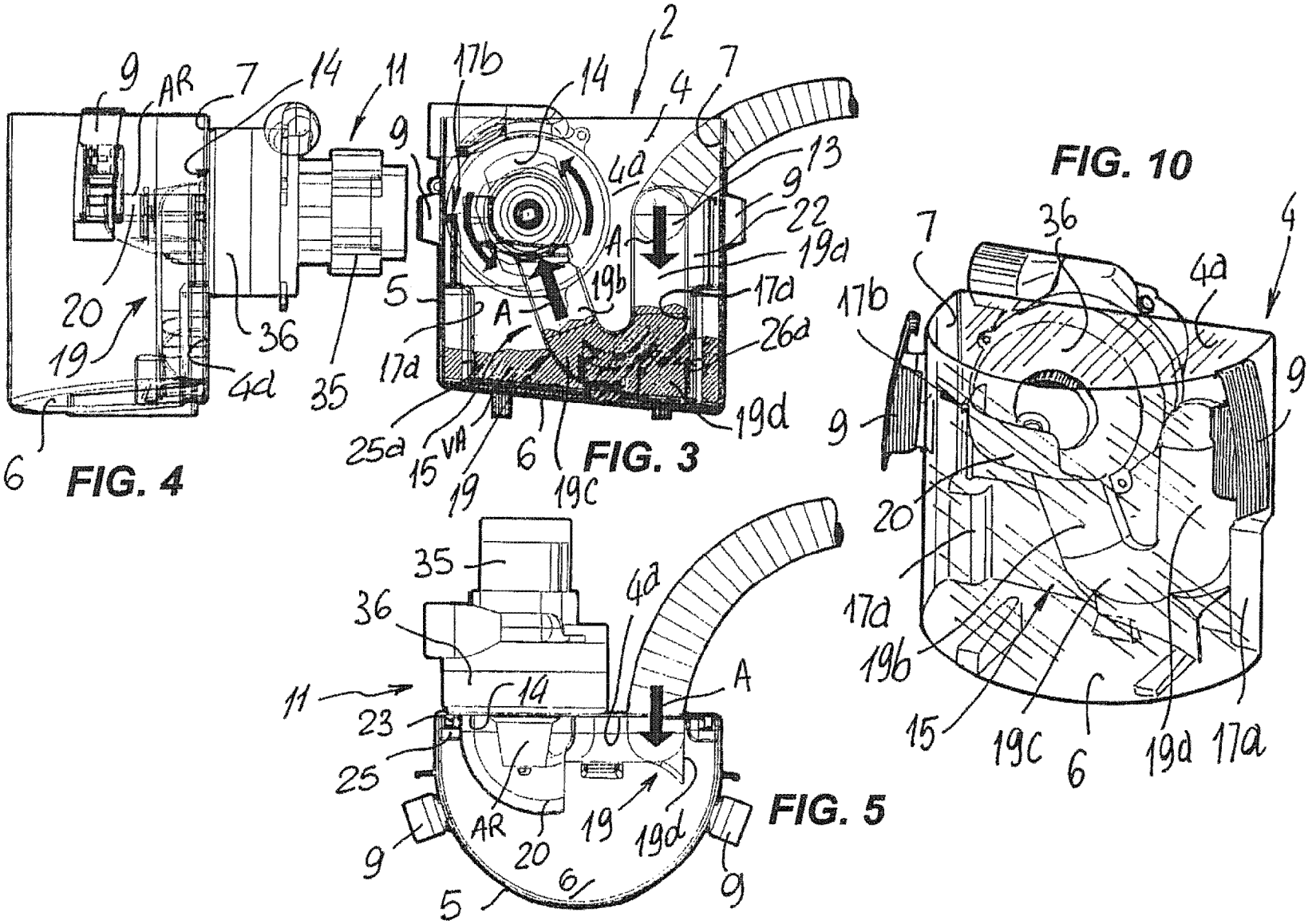
FIG. 3 is a phantom and enlarged front view of an inventive collection apparatus for collecting sucked up materials, according to a first version for wet collection of the sucked up materials.
FIG. 4 is a corresponding phantom side view of the apparatus of FIG. 3.
FIG. 5 is a corresponding phantom top view of the apparatus of FIG. 3.
FIG. 10 is a phantom perspective view of the first version of the collection apparatus, as shown in FIGS. 3 to 5.
Figures 6, 7, 8, 9:
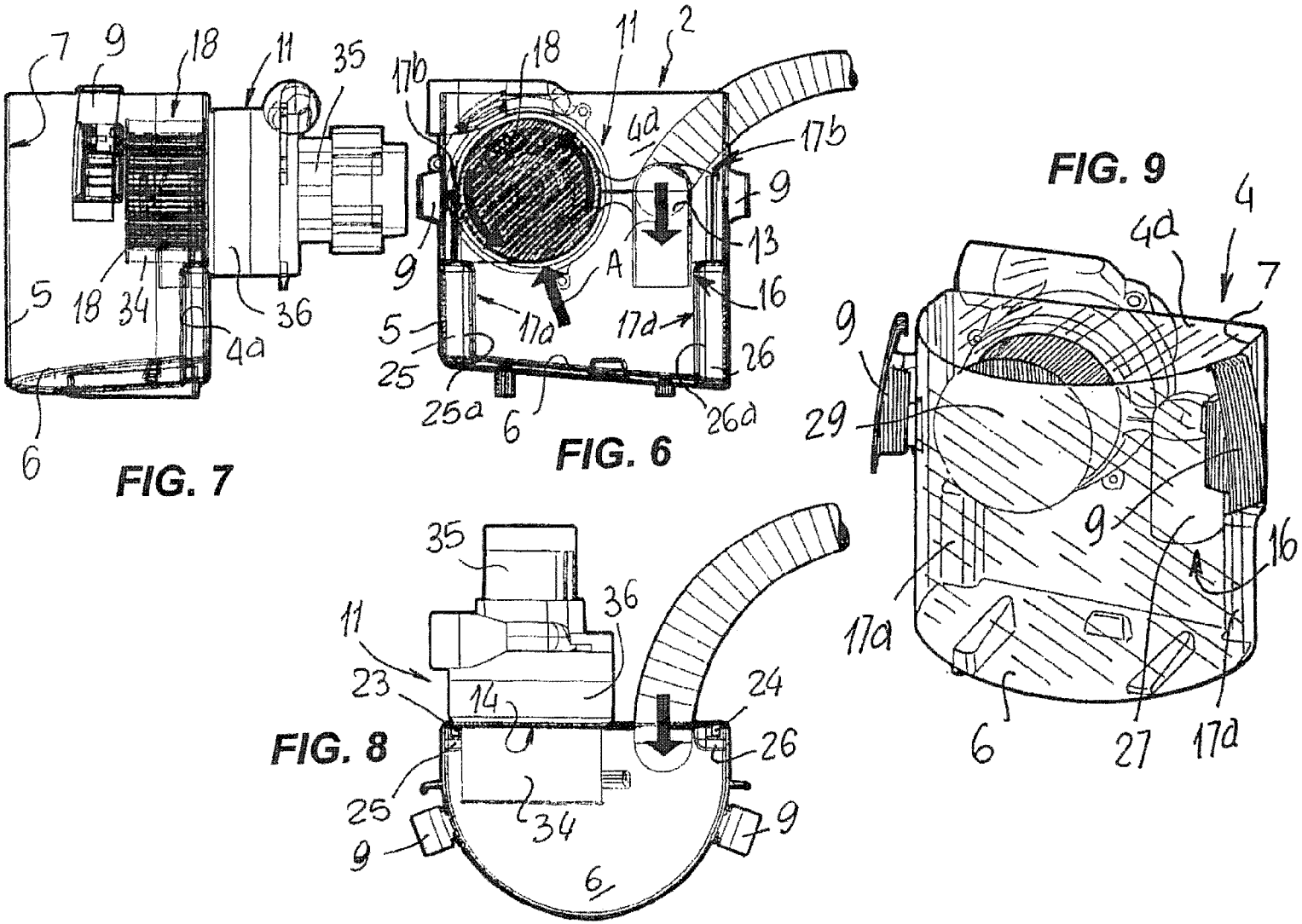
FIG. 6 is a phantom and enlarged front view of an inventive collection apparatus for collecting sucked up materials, according to a second version for dry collection of the sucked up materials.
FIG. 7 is a corresponding phantom side view of the apparatus of FIG. 6.
FIG. 8 is a corresponding phantom top view of the apparatus of FIG. 6.
FIG. 9 is a phantom perspective view of the second version of the collection apparatus, as shown in FIGS. 6 to 8.

A connecting aperture 19*d* is formed at such central section 19*c*, and allows the water volume "VA" to flow into the pipe, thereby substantially entirely filling the third central elbow section 19*c* and partially filling the first inlet section 19*a* and the second outlet section 19*b*, as shown in FIG. 3, where the hatched area schematically represents the water volume "VA".

A deflecting element 20 having such a shape as to divert the flows of sucked up air is provided at the outlet end of the section 19*b*, and emerges from the water volume "VA" towards the suction means 11.

Figure 14:
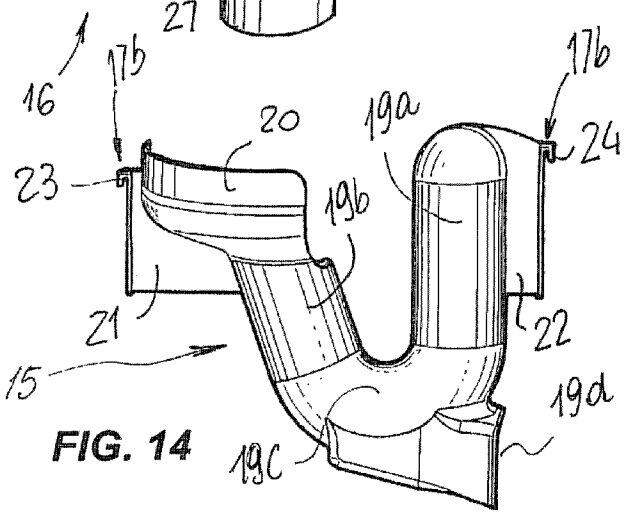
FIG. 14 is a corresponding front perspective view of the separation means as shown in FIG. 13.

As shown in FIGS. 13 and 14, two respective flat ribs 21 and 22 extend from the first section 19*a* and the second section 19*b*, to lie on a common plane and form respective hooks 23 and 24 designed for coupling with the mounting means 17*a* in the tank 4.

These mounting means 17*a* include respective columns 25 and 26, integrally rising from the bottom 6 of the tank 4, which have respective longitudinal guide grooves 25*a* and 26*a* for slideably receiving the corresponding ribs 21 and 22 until the hooks 23 and 24 abut against and engage with the upper ends of the columns 25 and 26.

Figure 11:
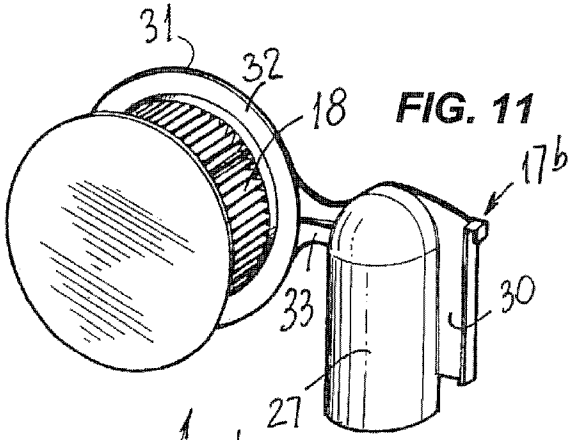
FIG. 11 is a rear perspective view of a version of the means for dry separation of the sucked up materials from the sucked up air flows.

Referring to FIGS. 6, 7, 8, 9, 11, 12 in greater detail, the dry separation means 16 include a straight conveying pipe section 27 which, like in the case of the wet separation means, originates at the inlet 13 of the tank 4 and has a closed front portion and, as shown in FIG. 11, an open rear portion, which is designed for watertight connection with the support wall 4*a* of the tank 4, when the separation means 16 are mounted therein as an alternative to the separation means 15.

The pipe section 27 extends towards the bottom 6 of the tank 4 to convey thereto the flows of air sucked up from the outside, and carrying sucked up debris and particulate matter suspended therein, which will be deposited on the bottom 6 mainly by gravity.

When the vacuum cleaner appliance 1 is operating, the suction unit 11 maintains a negative pressure in the interior compartment of the tank 4 and the flows of sucked up air are directed towards the outlet 14 which is nevertheless equipped with the filter 18 that separates any particulate residues from the flows of air sucked up by the suction unit 1, before reintroducing it into the environment.

Figure 12:
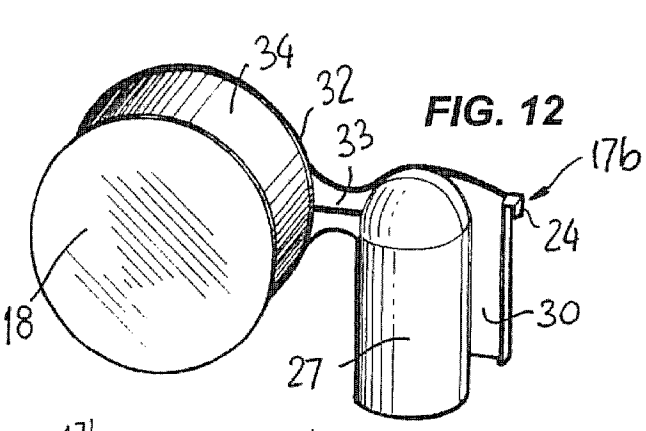
FIG. 12 is a corresponding front perspective view of the separation means of FIG. 11.

As shown in greater detail in FIGS. 11 and 12, the dry separation means 16 also have corresponding ribs extending outwards, namely a rib integral with the pipe section 27 and a rib 31 formed in a support 32 of the filter 18.

The pipe section 27 and the support 32 are also joined together by a transverse element 33 which makes them mutually integral, and forms one piece therefrom.

Also in this case, the ribs 30 and 31 are adapted to slidably engage in a corresponding one of the longitudinal grooves 25*a* and 26*a* and terminate with the hooks 23 and 24, as described above.

It shall be noted that the dry separation means 16 may be converted, if needed, into wet separation means, by loading the tank 4 with a sufficient water volume "VA" for surface water to be above the end of the pipe section 27 facing towards the bottom 6 and by fitting the filter 18 with a protective cover element 34, typically comprising a sponge sleeve that can block the passage of any water particles still suspended in the flows of sucked up air and directed towards the suction means 11.

The latter include a motor unit 35 with an axis of rotation "AR" extending towards the tank 4 and rotatably driving a fan 36 having a plurality of blades, not shown, passages being defined therebetween for the flows of purified air, which are directed outwards to be reintroduced into the environment.

Referring to FIGS. 3, 4, 6, 7, it shall be noted that the bottom 6 is inclined to the edge of the upper opening 7, with two inclinations, for spontaneous build-up of the collected debris in an area of the tank 4 located proximate to the connecting aperture 19*d* or of the lower end of the pipe section 27.

A more comprehensive version of the collection apparatus includes the combination with a UV emitter device, having a bactericide action, as shown in FIGS. 1*b* and 1*c* and referenced 40.

Here, the emitter device is mounted in the seat 3, but the skilled person will appreciate that it can be also directly mounted to a wall of the collection apparatus or to the lid 8.

The operation of the collection apparatus is as follows: whenever a user has to collect debris and particulate matter using the vacuum cleaner appliance 1 with the technique of wet collection and removal of sucked up materials, he/she will fit the tank 4, once it has been removed from the vacuum cleaner appliance 1, with the wet separation means 16.

For this purpose, he/she will slide the siphon pipe assembly 19 along the support wall 4*a*, with the flat ribs 21 and 22 inserted in corresponding guide grooves 25*a* and 26*a* formed in the columns 25 and 16 until the hooks 23 and 24 abut against the upper ends of the columns 25 and 26 and lock the sliding motion of the flat ribs 21 and 22.

In this position, the separation means 15 of the wet separation version are appropriately positioned in the tank 4.

The support wall 4*a* acts as a closing wall for the open rear portion of the pipe 19 and the central siphoning section 19*c* and the connecting aperture 19*d* touch lightly the bottom of the tank 4 in which the water volume "VA" is loaded to such a level as to substantially entirely fill both the central siphoning section 19*c* and the connecting aperture 19*d*.

Then the tank 4 is mounted to the vacuum cleaner appliance 1 and fixed thereto by means of the hooks 9, with watertight connection between the port 12 and the inlet 13 and between the axis of rotation "AR" and an aperture 13*a* formed in the wall 4 for this purpose.

As soon as mounting is complete, the upper opening 7 of the tank 4 is closed by the lid 8 and the user may turn on the vacuum cleaner appliance 1, which will suck up materials from the outside and convey them with the sucked up air into the water volume "VA" contained in the tank 4 through the first section 19*a* of the pipe 19.

Water bubbling causes the sucked up materials to separate from air flows in a traditional fashion and once air has been purified it flows into the section 19*b* of the pipe 19, from which it is conveyed towards the apertures formed between the blades of the fan 36.

After flowing past these apertures, it will be ejected again into the environment, possibly after flowing over the motor 35 to cool it and being purified from bacteria using the device 40.

The materials collected in the water volume "VA" deposit on the bottom 6 of the tank 4 after being discharged through the connecting aperture 19*d*.

The bottom 6 is inclined for spontaneous buildup of the materials collected and separated from air, in a predetermined area of the tank 4 from which they may be easily discharged by removing it from the vacuum cleaner appliance 1.

On the other hand, whenever a user wants to use the technique of dry removal of the sucked up materials i.e. debris and particulate matter, using the vacuum cleaner appliance 1, he/she may convert his/her vacuum cleaner appliance into one suitable for this purpose without having to use another vacuum cleaner appliance.

Typically, the user removes the tank 4, removes the lid 8 therefrom and replaces the wet separation means 15 contained therein with the dry separation means 16, which fit by their ribs 30 and 31 into the guide grooves 25*a* and 26*a* and come to watertight connection with the support wall 4*a* which closes their open rear sections.

Of course, the presence of the water volume "VA" in the tank 4 is not required in this case.

The user mounts the tank 4 back to the vacuum cleaner appliance 1 as described above, locks it and closes its upper opening 7 again by the lid 8.

As the user turns on the vacuum cleaner appliance 1, the sucked up air and the materials (debris and particulate matter) contained therein are diverted towards the bottom 6 by the pipe section 27, where the heavier ones progressively build up by gravity.

Then air is sucked up by the fan 36 driven by the motor 35 and, before being reintroduced into the environment, it flows through the cylindrical filter 18, which removes the residual dust particles.

It shall be noted that, in this version of the dry separation means 16 the latter may be also converted into wet separation means by simply mounting the protective element 34 peripherally to the filter 18 and by loading the tank 4 with the water volume "VA" while taking care that the level is maintained slightly above the lower end of the pipe section 27, so as to bubble the air flows and sucked up materials in the water volume "VA".

The protective element 34 may consist, for instance, of a sponge sleeve, which blocks on one side any water particles left after bubbling in suspension in the air flows directed to the filter 18 and the motor 36 and allows on the other side the passage of purified air that has to be reintroduced into the environment after purification.

The invention was found to fulfill the intended objects, i.e. allowing collection of particulate matter and debris with two different methods in a single vacuum cleaner appliance.

The invention so conceived is susceptible to a number of changes and variants within the inventive concept.

Furthermore, all the details may be replaced by other technically equivalent parts.

In practice, any materials, shapes and sizes may be used as needed, without departure from the scope of the following claims.

The invention claimed is:

1. A collecting apparatus of sucked materials for vacuum cleaner appliances comprising:

a tank having a bottom, peripheral walls and one upper opening opposing said bottom and closable by a removable lid;

sucking means coupled to said tank to create a negative pressure on an inside of said tank; and separating means of sucked material extracted from a sucked air flow in a sucking direction defined between an inlet into said tank and an outlet from said tank, wherein said separating means are selected from the group consisting of wet separating means and dry separating means, said wet separating means and dry separating means being configured to be alternatively and replaceably assembled within said tank with mounting means, wherein said separating means comprise:

a channeling duct of said sucked air flow from outside into said tank according to said sucking direction; and a separating element between said sucked material and said sucked air flow arranged downstream of, and fluid-dynamically connected with, said channeling duct, and wherein said channeling duct comprises a siphon shaped duct having:

a first inlet section configured to be coupled with said inlet obtained in said tank;

a second outlet section facing said sucking means; and a third intermediate siphoning hairpin bended section fitted between said first inlet section and said second outlet section, wherein a connecting opening with said separating element is provided in said intermediate siphoning section.

2. The apparatus according to claim 1, wherein said separating element comprises a liquid volume loaded in said tank and defining a water surface, said sucked material being released into said liquid volume.

3. The apparatus according to claim 1, wherein said a second outlet section comprises an outlet end having a deflecting lip deflecting air flows and liquid particles toward said sucking means.

4. The apparatus according to claim 1, wherein said sucking means comprise dynamic sucking means of said sucked material from said sucked air flow.

5. The apparatus according to claim 1, wherein said sucking means comprise a rotatable dynamically-separating arrangement, said rotatable dynamically-separating arrangement comprising:

a rotating fan actuated by a motor group and fluido-dynamically connected to said tank; and a plurality of radial blades defined in said fan, wherein pass-through openings of air flows between said tank and said sucking means are obtained among said radial blades.

6. The apparatus according to claim 1, wherein said mounting means comprise:

at least two supporting members fitted inside said tank; and a couple of resting means associated to said separating means and configured to be coupled with said support members.

7. A collecting apparatus of sucked materials for vacuum cleaner appliances comprising:

a tank having a bottom, peripheral walls and one upper opening opposing said bottom and closable by a removable lid;

sucking means coupled to said tank to create a negative pressure on an inside of said tank; and separating means of sucked material extracted from a sucked air flow in a sucking direction defined between an inlet into said tank and an outlet from said tank, wherein said separating means are selected from the group consisting of wet separating means and dry separating means, said wet separating means and dry separating means being configured to be alternatively and replaceably assembled within said tank with mounting means.

wherein said mounting means comprise:

at least two supporting members fitted inside said tank; and a couple of resting means associated to said separating means and configured to be coupled with said support members, and wherein said supporting members comprise columns elevating from said bottom and having longitudinal guiding grooves, and wherein said resting means comprise ribs slidably engageable into said guiding grooves and ending with respective stopping and resting elements on ends of said columns facing said removable lid.

8. The apparatus according to claim 1, wherein said bottom is inclined according at least one inclination angle in relation to a horizontal plane.

9. The apparatus according to claim 1, wherein said bottom is inclined according at least two inclination angles in relation to a horizontal plane.

10. The apparatus according to claim 1, further comprising an antibacterial light source associated to said tank.

11. A vacuum cleaner comprising:

a collecting apparatus of sucked material having, a tank having a bottom, peripheral walls and one upper opening opposing said bottom and closable by a removable lid, sucking means coupled to said tank to create a negative pressure on an inside of said tank, and separating means of sucked material extracted from a sucked air flow in a sucking direction defined between an inlet into said tank and an outlet from said tank, wherein said separating means are selected from the group consisting of wet separating means and dry separating means, said wet separating means and dry separating means being configured to be alternatively and replaceably assembled in said tank with mounting means, wherein said separating means comprise:

a channeling duct of said sucked air flow from outside into said tank according to said sucking direction; and a separating element between said sucked material and said sucked air flow arranged downstream of, and fluid-dynamically connected with, said channeling duct, and wherein said channeling duct comprises a siphon shaped duct having:

a first inlet section configured to be coupled with said inlet obtained in said tank;

a second outlet section facing said sucking means; and a third intermediate siphoning hairpin bended section fitted between said first inlet section and said second outlet section, wherein a connecting opening with said separating element is provided in said intermediate siphoning section.

* * * * *